United States Patent [19]

Hanks

[11] 4,002,188

[45] Jan. 11, 1977

[54] WOVEN SHADE SCREEN

[75] Inventor: Albert Hanks, Tuscaloosa, Ala.

[73] Assignee: Phifer Wire Products, Inc., Tuscaloosa, Ala.

[22] Filed: Dec. 15, 1975

[21] Appl. No.: 640,868

[52] U.S. Cl. ..... 139/420 R; 139/420 C; 139/425 R; 139/426 R

[51] Int. Cl.[2] ..... D03D 1/00

[58] Field of Search ..... 139/383, 384, 416, 417, 139/420 R, 420 C, 425, 426 R

[56] References Cited

UNITED STATES PATENTS

| | | | |
|---|---|---|---|
| 820,994 | 5/1906 | Smith | 139/420 |
| 2,817,371 | 12/1957 | Bussiere | 139/383 |
| 3,417,794 | 12/1968 | Lynch et al. | 139/426 |
| R23,603 | 12/1952 | Rohs et al. | 139/383 |

*Primary Examiner*—Henry S. Jaudon
*Attorney, Agent, or Firm*—Patrick F. Henry

[57] ABSTRACT

A woven fabric shade screen comprising substantially even spaced elongated strands in one direction, such as the fill direction, and groups of more closely spaced strands woven so that the two outside strands alternate respectively being over and under successive fill strands while the inside four strands in each group are arranged so that the third and fifth strands are under a fill wire while the second and fourth strands are over, thus providing alternate strands which alternate each fill strand.

3 Claims, 2 Drawing Figures

WOVEN SHADE SCREEN

BACKGROUND OF THE INVENTION

1. Field of the Invention

Woven screen fabrics.

2. Description of the Prior Art

Shade screening made from woven strands or other members of synthetic as well as metal material are well known in the art. However, some woven screen materials which have good qualities of admitting light or air have poor qualities from the standpoint of filtering out glare and unwanted light. On the other hand, certain other woven screen has excellent qualities of blocking out undesirable light and glare but have poor quality from the standpoint of admitting air and desirable light. Also, some woven shade screen materials are not easy to weave and after weaving do not remain in the original woven condition. Therefore, with the various advantages and disadvantages of known woven screen there is still a need for one which is suitable from a weaving standpoint and possesses the desired qualities of admitting wanted light and air but blocking out unwanted sunrays and glare. Some prior art weaves utilize groups of wires in both the warp and fill direction whereas the present arrangement utilizes single substantially equally spaced strands or wires in one direction which can be the fill direction.

SUMMARY OF THE INVENTION

An object of this invention is to provide a woven shade screen which may be woven using substantially equally spaced single strands in either the warp or fill direction interlocked by groups of strands in the other direction.

Another object of this invention resides in the particular arrangement of the groups of six interlocking strands which are arranged in such a way as to lend itself to proper weaving on a loom and at the same time maintain the stability of the woven cloth.

An additional object of this invention resides in the specific use of groups of six strands alternating from over under, over under, over under at one fill wire to under over, under over, under over, at the next fill wire.

Other objects and advantages of the present invention will be readily understood and appreciated upon reading the following detailed description of the preferred embodiment taken in conjunction with the accompanying drawings.

DESCRIPTION OF A PREFERRED EMBODIMENT

Figure 1:
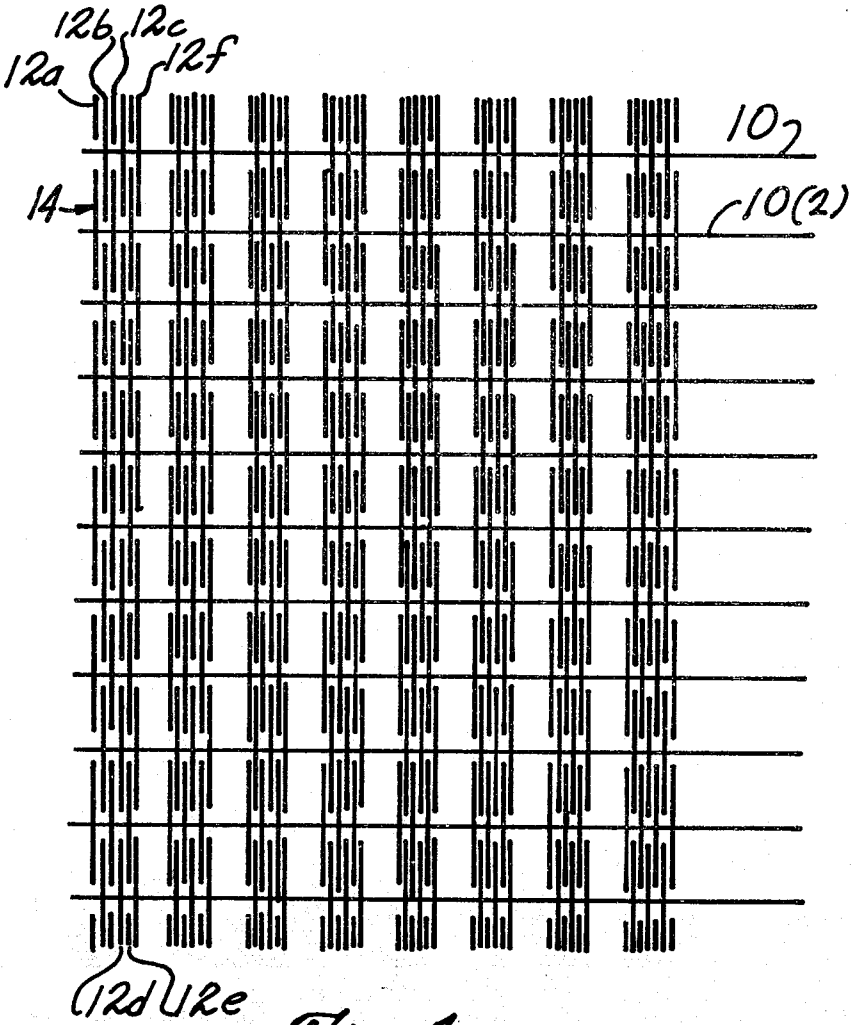
FIG. 1 is a diagrammatic view of a woven screen fabric made in accordance with the present invention.

As seen in the diagrammatic view of FIG. 1, the vertical strands 12 are broken at the intersection with horizontal strands 10 to represent crossing under rather than over as shown in full lines. The present invention is shown as a typical example of a continuously woven fabric having a 13 mil filler and a 14 mesh in the fill direction and with a 11 mil warp strand for a 54 mesh in the warp direction which is a 53.24 mesh actual on a 17 ¾ reed and of the sort normally utilized for shade screening and sometimes referred to as insect screen.

The strands 10 are spaced from each other in the fill direction and strands 12*a* through 12*f* in the warp direction may be of any of the many well known materials such as fibers utilized for woven screen including plastic coated fiberglas, coated metal, solid plastic strands and many others. In the case of the use of glass fiber threads the individual threads may be of a denier ranging anywhere from about 600 to 1200 or more provided with heat reflecting coating.

Figure 2:
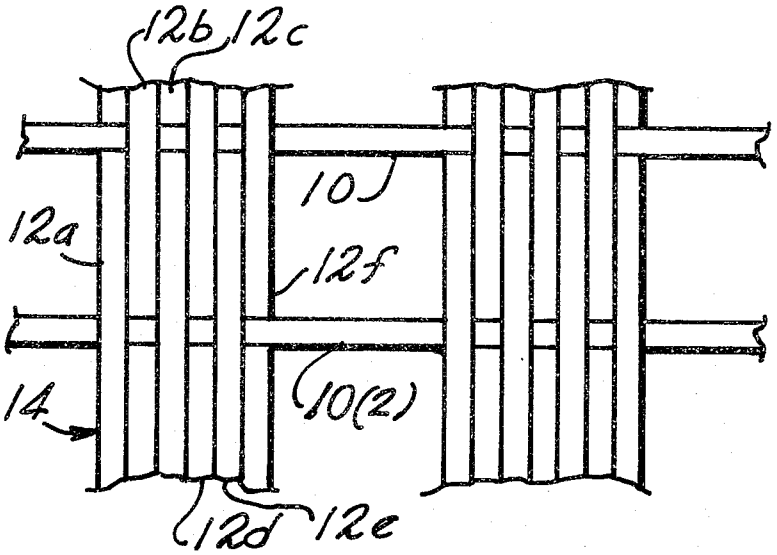
FIG. 2 is an enlarged view of a portion of woven screen the same as that shown in the diagrammatic view of FIG. 1.

The strands 12*a* through 12*f* in the warp direction are arranged in groups which resemble any actual wire in actual size solid strips which are actually made of the individual side-by-side small strands 12*a* through 12*f* interlocked with respective fill strands 10. Thus, there are a group of strands 12*a* through *f* which are designated by reference numeral 14 arranged in the pattern of alternate strands being over and under and also alternating in the over and under pattern from one fill strand 10 to the next. For example, referring to the uppermost fill strand 10 in FIG. 1 on the group 14 in the uppermost lefthand side of the sheet it is seen that the strand 12*a* passes under whereas the next strand 12*b* passes over and the next strand 12*c* passes under and so forth alternating and then in the next fill strand 10 which is designated for purposes of discussion as strand 10(2). The group individual strands 12*a* thru 12*f*, inclusive, alternate over strand 10(2) so that the strand 12*a* which was under the strand 10 in the previous interlocking just described is now over strand 10(2) whereas the strand 12*b* is under the strand 10(2) as represented by the broken lines in the diagrammatic view as contrasted with the solid lines which pass over and intersect. Thus, as illustrated in FIGS. 1 and 2, in certain groups 14 there are six strands alternating one strand over and one strand under except that there may be other groups which include 7 strands.

In this art it is well known to coat the particular material used with various colors and sometimes heat reflecting material and including a plastic compound utilizing various colors and dyes, chemicals and otherwise.

While I have shown and described a particular embodiment of this woven shade screen wire in special detail this is by way of illustration and in order to disclose an embodiment thereof rather than to confine the invention to such a specific arrangement. Therefore, there are various alterations, changes, deviations, eliminations, substitutions, omissions and departures which may be made in the particular embodiment shown and described without departing from the scope of this invention as defined only by a proper interpretation of the appended claims.

What is claimed is:

1. A woven shade screening fabric: a plurality of individual, spaced strands in parallel relationship in one direction of either the warp or fill of a woven fabric and comprising individual strands in substantially a uniform pattern, a plurality of groups of six substantially parallel individual strands closely associated in side-by-side relationship in the other direction of the fabric of the warp and fill from that of the preceding described uniform strands, said groups of strands being equally spaced to provide an open weave mesh pattern therebetween for the purpose of admitting some light and air while blocking some of the glare and sunlight, and the strands in each of said groups being arranged one strand over and the next strand under in alternating interlocking relationship at the point of crossing each of the respective individual strands in the other direction whereby in each point of intersection some of said strands are over and some of said strands are under and the next successive crossing of groups of strands alternate from the preceding one, each of the next successive strands alternating from over to under at each intersection and then alternating from under to over at the next intersection.

2. The screen fabric in claim 1 wherein there are groups which comprise seven strands.

3. The screen fabric in claim 1 wherein there is a 13 mil filler and a 14 mesh in the fill direction and a 11 mil warp with a 54 mesh in the warp direction to provide a 53.25 mesh on a 17 ¾ reed.

* * * * *